US007654663B2

(12) United States Patent
Knierim et al.

(10) Patent No.: US 7,654,663 B2
(45) Date of Patent: Feb. 2, 2010

(54) TRANSFIX ROLLER LOAD CONTROLLED BY MOTOR CURRENT

(75) Inventors: David L. Knierim, Wilsonville, OR (US); Michael E. Jones, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 432 days.

(21) Appl. No.: 11/240,955

(22) Filed: Sep. 30, 2005

(65) Prior Publication Data

US 2007/0076080 A1 Apr. 5, 2007

(51) Int. Cl.
*B41J 2/01* (2006.01)

(52) U.S. Cl. ..... 347/103; 347/104; 399/55; 399/101; 399/121; 399/167; 399/402; 271/117; 346/21

(58) Field of Classification Search ..... None
See application file for complete search history.

(56) References Cited

U.S. PATENT DOCUMENTS

| | | | | | |
|---|---|---|---|---|---|
| 2,938,948 | A * | 5/1960 | Hell | 358/412 |
| 4,538,156 | A * | 8/1985 | Durkee et al. | 346/21 |
| 4,905,053 | A * | 2/1990 | Matsuo et al. | 399/402 |
| 4,939,541 | A * | 7/1990 | Sugiura | 399/2 |
| 5,557,312 | A * | 9/1996 | Sago | 347/171 |
| 5,608,430 | A * | 3/1997 | Jones et al. | 347/8 |
| 5,820,275 | A * | 10/1998 | Crawford et al. | 400/185 |
| 6,042,217 | A * | 3/2000 | Jones | 347/32 |
| 6,106,113 | A * | 8/2000 | Yamazaki et al. | 347/103 |
| 6,244,182 | B1 * | 6/2001 | Lin et al. | 101/480 |
| 6,382,619 | B1 * | 5/2002 | Gustafson et al. | 271/117 |
| 6,585,368 | B1 * | 7/2003 | Park | 347/103 |
| 6,651,973 | B2 * | 11/2003 | Gaarder et al. | 271/117 |
| 7,400,852 | B2 * | 7/2008 | Furukawa | 399/302 |
| 2005/0083395 | A1 * | 4/2005 | Kubota et al. | 347/215 |
| 2007/0103531 | A1 * | 5/2007 | Jones et al. | 347/103 |

FOREIGN PATENT DOCUMENTS

| | | |
|---|---|---|
| EP | 0 601 531 A1 | 6/1994 |
| EP | 1 533 990 A1 | 5/2005 |
| EP | 1 563 996 A1 | 8/2005 |

OTHER PUBLICATIONS

Step Motors Reference Guide — Available Aug. 2000. http://web.archive.org/web/20000830153844/http://www.ams2000.com/stepping101.htm.*

* cited by examiner

*Primary Examiner*—Matthew Luu
*Assistant Examiner*—John P Zimmermann
(74) *Attorney, Agent, or Firm*—Marger Johnson & McCollom, P.C.

(57) ABSTRACT

A printing device includes an image receptor adapted to have formed thereon an inked image layer, a transfer roller, and a transfer roller biasing system. The biasing system is structured to displace the transfer roller toward the image receptor upon actuation of a motor, exerting a backing pressure.

19 Claims, 5 Drawing Sheets

TRANSFIX ROLLER LOAD CONTROLLED BY MOTOR CURRENT

FIELD

The present disclosure relates to an apparatus for transferring and fusing an image layer from an image receptor to a recording medium, such as paper, and more specifically to a transfix-stage roller configured to apply a roller load controlled by a motor current.

BACKGROUND

Printing devices, such as inkjet printers, can produce an image on a recording medium (e.g., paper) by forming an image layer on an image receptor, transferring the image layer to the recording medium, and fusing the transferred image to the recording medium. In some processes, the transfer and fusion steps are contemporaneously performed (hereinafter referred to as "transfusing" or "transfixing"). The locus of contact is commonly referred to as the nip.

Using solid-ink compositions currently available in the industry, transfer of the image layer from the image receptor (in the form of a belt or drum) to the recording medium is generally accomplished by contacting the image layer with the recording medium under pressure and, if desired, heat. Transfixing pressure is typically provided in the nip by a roller selectively biased against the recording medium. High-speed printers generally require controlled high pressures, generally in the range of about 550 pounds per square inch (approximately 250 kg/in$^2$) to more than 2000 psi (approx. 900 kg/in$^2$) depending on the particular solid ink compositions employed, the size of the recording medium, desired print quality (e.g., draft, final), applied heat, and the like.

Transfix roller load heretofore has been controlled by one or more pre-tensioned springs. A motor or other retracting means is utilized to retract the roller from the nip or to extend the roller into the nip, against the tension of the spring(s). The spring tension may be created by either of compression or extension of the spring from its resting state.

Springs generally deliver a slightly fluctuating roller load depending on variations in paper, device component run-out and the like. To provide effective pressure delivery, printing device manufacturers have produced devices having precise and minimal run-out of the transfixing roller and the image receptor drum, employed innovative ink compositions to control image layer thickness, viscosity and transfer properties, and urged use of consistent recording media.

As well, printing devices with tensioned springs generally require more complicated manufacturing processes and add bulk to the finished product. Highly tensioned spring elements within a printing device chassis may potentially be dangerous to assembly and/or repair personnel.

It would be desirable to provide transfix roller load without use of tensioned, high-strength springs. Further desirable is the capacity to vary the load force based on image content and print mode. If text only prints could run at reduced load, for example, roller life would increase and power consumption would decrease.

DETAILED DESCRIPTION

Printing devices generally use an offset printing process and piezoelectric print head technology that jets solid ink. Such printing devices are described in U.S. Pat. Nos. 6,648,467 and 6,713,728, which disclosures are incorporated by reference herein.

Figure 1:
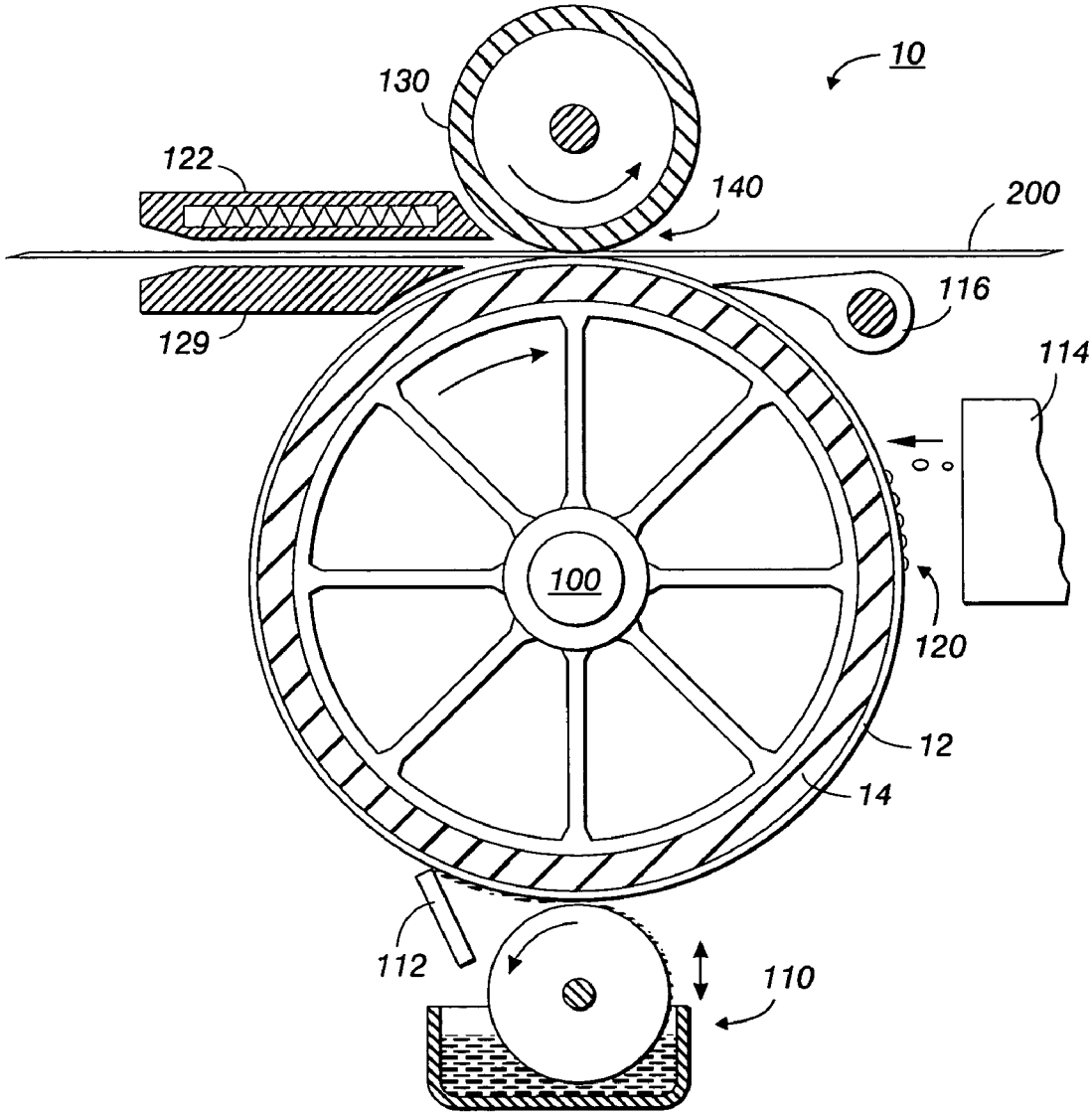
FIG. 1 is a diagram of a printing system having a transfer roller.

FIG. 1 shows an example of a printing system. Printing system 10 transfers and inked image from an intermediate surface to some print media. A print head 114 places an ink in the liquid or molten state to form an image layer 120 on the surface 12 of the image receptor 100. The surface 12 of the image receptor 100 may be a liquid layer applied using the applicator assembly 110. Applicator assembly 110 may include an applicator 112 to apply the liquid.

The print or recording medium 200 is guided by the guide 129 and heated by the heater 122. The preheated medium 200 receives the image from image layer 120 while the medium is in the space between the pressure roller 130 and the image receptor 100, referred to as the nip. As shown here, the gap 140 between the pressure roller 130 and the image receptor 100 will close to form the nip. The recording medium 200 may then be separated from the image receptor surface by the stripper finger 116.

Figure 2:
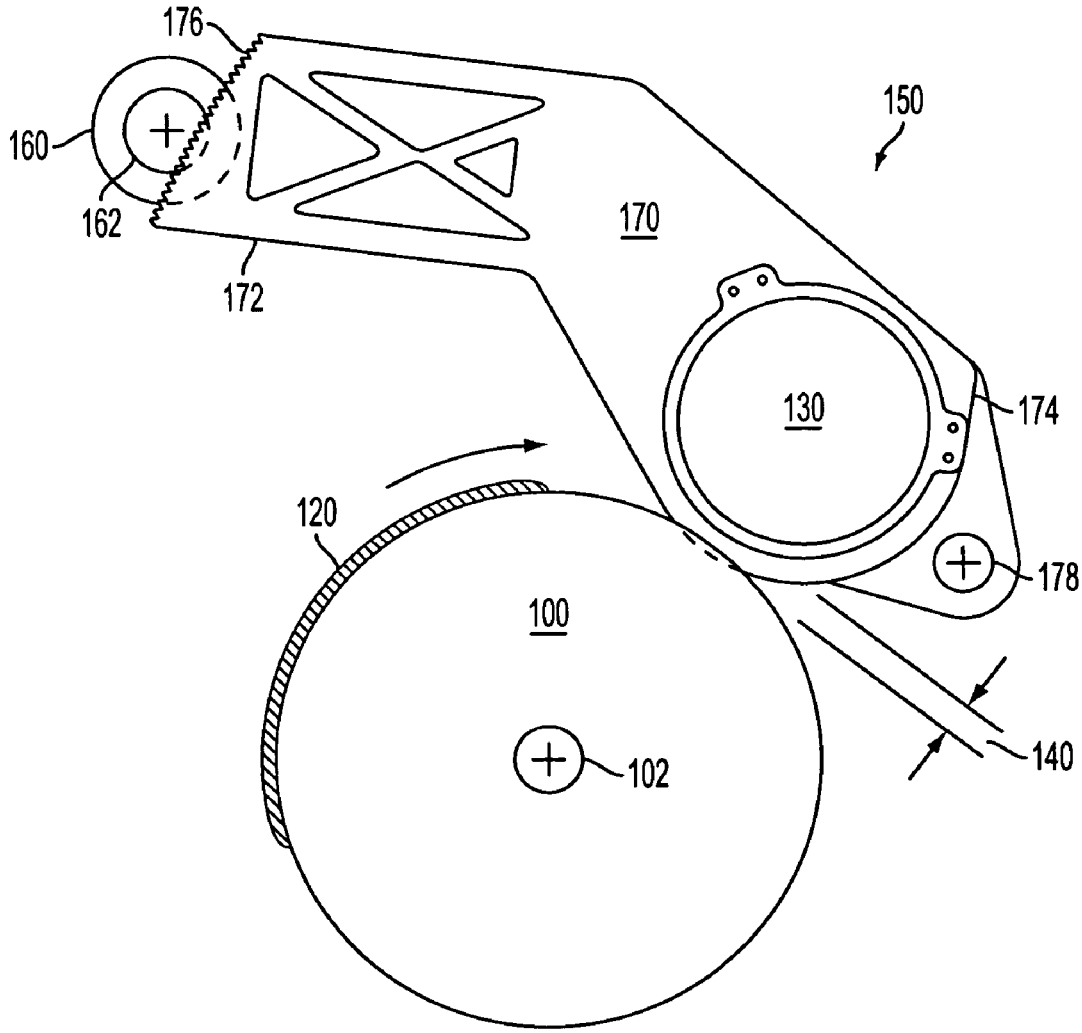
FIGS. 2-3 are diagrams of a substructure of the embodiment of FIG. 1 with the transfer roller shown in retracted and extended states, respectively.
Figure 3:
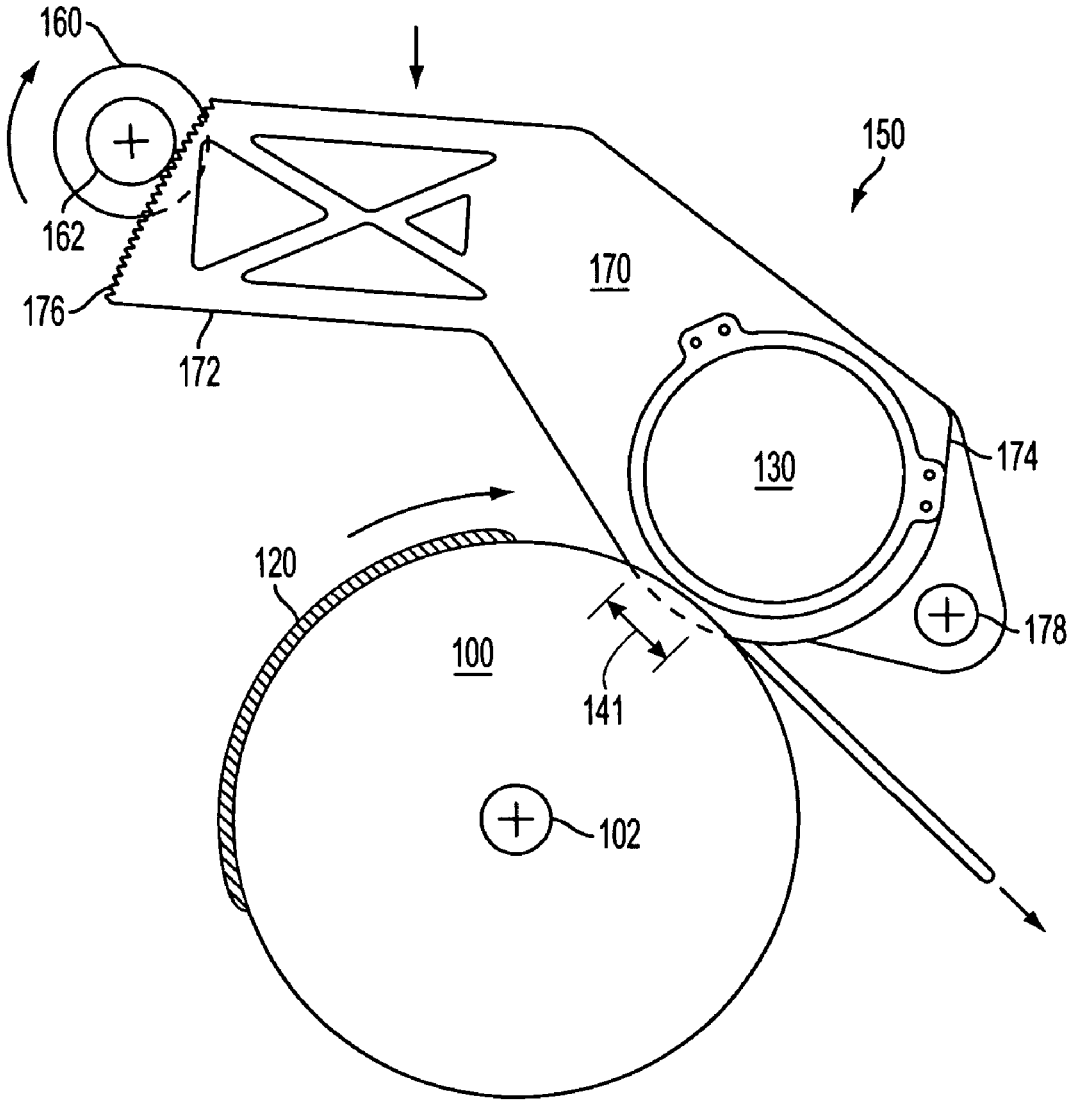

Turning to more detailed view of the roller shown in FIGS. 2 and 3, a first embodiment of an ink jet printing device generally has an image receptor 100, shown here as a drum on an image receptor axle 102, on which is formed an image layer 120 from one or more ink compositions. The axle is journaled in a rigid frame or chassis. The transfer or pressure roller 130 is positioned adjacent the drum 100. As mentioned above the space between the transfer roller 130 and the image receptor 100 defines the gap 140 that closes to form the nip.

The application of a backing pressure facilitates transfer of the image layer 120 from the image receptor 100 to the recording medium 200. A common nip dimension is about 1-2 mm. The transfer roller 130 can be biased against a recording medium 200, such as paper, in the nip to facilitate transfer of the image layer 120 to the paper.

Further provided in the first embodiment is a transfer roller loader assembly 150, referred to here as a loader, at each end of the transfer roller 130. Each loader 150 of this embodiment includes a motor 160 rigidly mounted on the frame and a rotor 162. The motor can be a stepping motor (e.g., SST-59D stepper motor, Shinano Kenshi Corp., Culver City, Calif.) or a brushed or brushless DC motor.

The loader 150 of this embodiment further includes a sector gear 170 having a first end 172 and a second end 174. An engager 176 is disposed at the first end 172, meshed with a small gear on the rotor 162 to provide an initial stage of leverage, and a fixed pivot 178 is disposed in this embodiment at the second end 174. The pivots 178 are affixed to the frame at a spacing relative to the first end 172 and the transfer roller 130 to provide additional leverage.

A transfer roller loader 150 couples the sector gear 170 to the transfer roller 130; in the embodiment shown, the transfer roller loader 150 directly couples an axle (not shown) of the transfer roller 130 to the body of the sector gear 170.

The sector gear is thereby pivotably anchored to a printing device chassis, such that clockwise rotation of the rotor 162 acts upon the first end 172 of the sector gear 170 to downwardly move the first end 172. Working through pivot 178, disposed near the second end 174 in this embodiment, the second end 174 of the sector gear 170 is downwardly displaced. Coupled thereto, the transfer roller likewise is downwardly displaced toward the image receptor 100 by the pivoting of the sector gear 170 to apply force. The gap 140 from FIG. 2 is closed and the nip 141 is formed. This operation is reversed to move the transfer roller 130 away from the image receptor 100.

Figure 4:
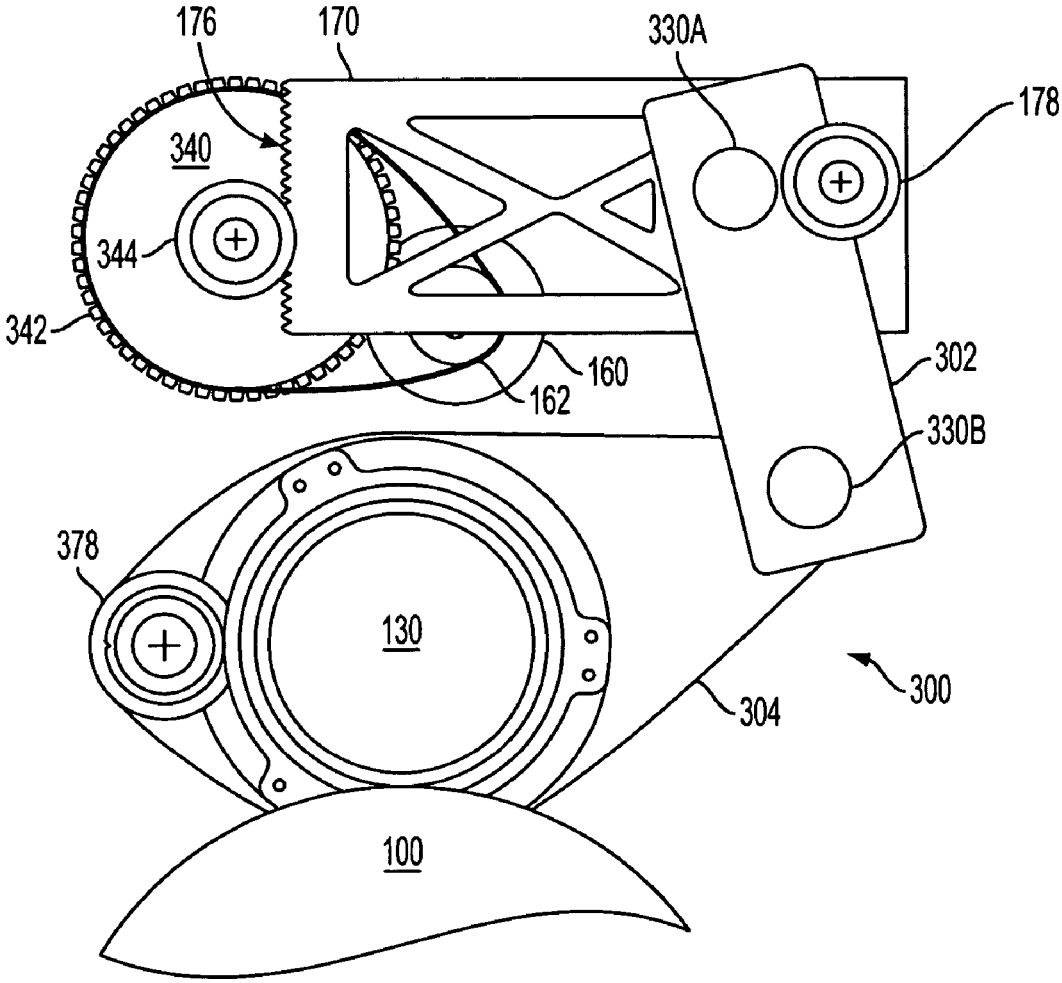
FIG. 4 is a diagram of a second embodiment roller load controller apparatus.

While the embodiment of FIGS. 2-3 has the sector gear engager 176 directly engaged by the rotor 162 and the transfer roller 130, other mechanical arrangements are possible. A second embodiment as shown in FIG. 4 shows a transfer roller loader comprising a more complex transfer roller loader assembly 300. This arrangement provides additional leverage stages.

In more detail, the second embodiment transfer roller loader 300 comprises a motor 160 having a rotor 162, a sector gear 170, linkage members 302, 304 and additional pivots 330A, 330B. Linkage members 302, 304 can be structured to convert the rotational force of the rotor 162 into additional leverage of the transfer roller 130 within a compact space. In the embodiment of FIG. 4, linkage members 302, 304 are pivotably coupled via pivot 330B. Pivot 330A connects linkage member 302 to the second end 174 of the sector gear 170.

Pivots 330A, 330B are not rigidly mounted to the printing device chassis, whereas pivots 178, 378 pivotably secure the sector gear 170 and linkage member 304 to fixed locations on the printing device chassis to facilitate levered movement of linkage member 304 and the transfer roller 130 coupled thereto.

The transfer roller loader 300 of FIG. 4 further includes a reduction gear 340 having a reduction input gear 342 and a reduction output gear 344. The reduction gear 340 is coupled to the rotor 162 engaging the reduction input gear 342 via a toothed belt to produce an output of increased torque at the reduction output gear 344. The small output gear 344 in this embodiment engages the sector gear engager 176.

One or more intermediate reduction gears can be utilized in consideration of the angular resolution and torque of the motor 160, the desired backing pressure, the leverage generated between rotation of the rotor 162 and displacement of the transfer roller 130, nip dimensions, and other factors. In a printing device having a nip gap of approximately 1-2 mm, it is preferable that the reduction gears be employed to increase rotation of rotor 162 based on the motor 160 selected. In this embodiment using the aforementioned 59-series stepper motor, for example, the overall reduction is approximately 15-fold, such that one rotation of rotor 162 translates to about 1.15 mm of transfer roller displacement.

Figure 5:
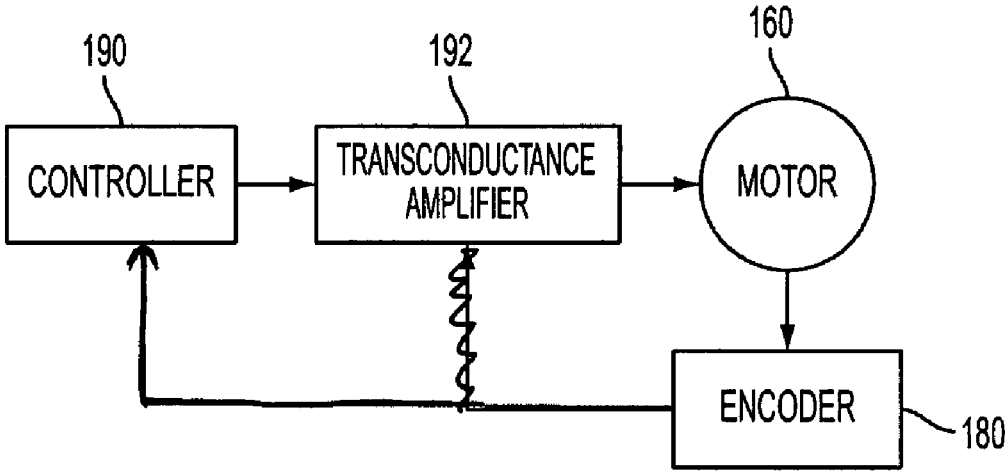
FIG. 5 is a flowchart diagram of a first embodiment transfer roller pressure loading system and method.

The present printing device provides a controlled motor torque output that is proportional to motor current to load the transfer roller 130. This arrangement removes the need for primary biasing springs, instead using motor current as a virtual spring. The motor current can be adjusted to give different roller load forces as each print requires. An example of a control circuit for controlling the motor current is shown in FIG. 5. The motor 160 may have attached to the shaft a position encoder 180. The encoder provides the motor shaft position to the controller 190, which in turn uses the position information to ensure that the phase angle of the of the motor current tracks the physical rotor angle. The controller sends a voltage signal to the transconductance amplifier 192 that outputs a current proportional to the voltage signal from the controller. The controller adjusts the voltage as necessary to provide the appropriate current to the motor.

The motor 160 need not have a rotary output shaft as shown in the illustrations. A linear-acting motor output, for example, can alternatively be applied without departing from the teachings herein.

By way of illustration and not limitation, a representative calculation of force is presented. In this example, a sector gear 170 covering 70° of eccentric rotation from 50° to 120° (where 0° would be the maximum separation of the transfer roller 130 from the drum 100) is driven by the rotor 162. The eccentric radius is 1 mm, the eccentric gear radius 100 mm, and the motor gear radius 6 mm. In this hypothetical arrangement, the transfer roller 130 would move 60 um per motor radian. This arrangement further results in a 0.9 Nm motor torque for a 15,000 N roller load (i.e., 3370 lbs roller load). This example is 81 watts for a 0.1 $Nm/(w)^{-1/2}$ motor.

Figure 6:
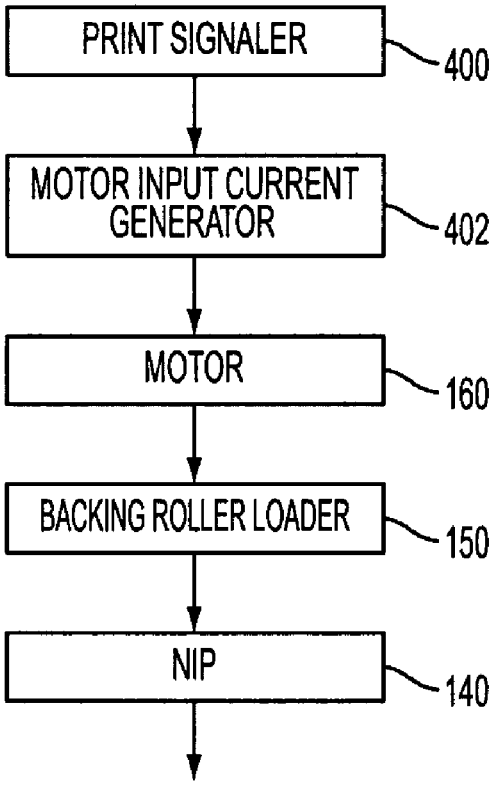
FIG. 6 is a diagram of a control circuit for the transfer roller pressure loading system.

The transfer roller loader 150 generally is structured to releasably displace the transfer roller 130 against the image receptor 100 to contact the image layer 120 on the image receptor 100 and the recording medium 200 with a predetermined backing or rolling pressure. Turning to FIG. 6, a print signaler 400 communicates a print signal to a motor current generator 402, which in turn delivers an input current to a stepping motor or DC motor 160. As previously described, current to the motor 160 rotates its rotor 162 and displaces the transfer roller loader 150 to move the transfer roller toward the drum 100, applying a backing pressure at the nip 140.

The transfer roller load system as described herein can be enjoyed in a variety of ways without departing from the novel principles disclosed herein. For example, a roller load system can be disposed at each end of a transfer roller, or a single motor can be utilized with mechanical structure sufficient to translate the motor output to the transfer roller. As well, an embodiment having motors at each end of a transfer roller axle may apply the same of independently differing motor outputs, the latter to account for misalignment of the transfer roller and image receptor (e.g., drum) axles. A single-motor embodiment may nevertheless also incorporate structures to allow differential applications of the motor output at the different ends of the transfer roller axle. Likewise, the motor output need not be applied to the transfer roller at the end thereof, but may instead be applied intermediate the ends.

It will be appreciated that various of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A printing device, comprising:

an image receptor adapted to have formed thereon an image layer;

a transfer roller positionable to at least one of a contact position and a non-contact position;

a motor accepting an electrical input current and producing a motor output directly proportionate thereto;

a controller to select the electrical input current from a plurality of input currents when the transfer roller is in the contact position based upon a print requirement, wherein the print requirement includes at least one of print quality, recording medium type, image parameters, print speed, and image tonal composition;

means for biasing the transfer roller into pressure contact with the image receptor in response to the motor output, wherein the plurality of input currents determine a selectable backing pressure of the transfer roller against the image receptor.

2. The printing device of claim 1 wherein the motor is selected from the group consisting of a stepping motor, a brushed direct current motor and a brushless direct current motor.

3. The printing device of claim 1 wherein the means for biasing the transfer roller is to act directly proportionate to the motor output.

4. The printing device of claim 1 wherein the means for biasing the transfer roller into pressure contact with the image receptor includes means for reducing a mechanical value of the motor output.

5. The printing device of claim 4 wherein the means for reducing a mechanical value of the motor output includes a reduction gear.

6. A printing device, comprising:

an image receptor;

a transfer roller positioned adjacent the image receptor, the transfer roller positionable to at least one of a contact position and a non-contact position;

a controller to select an electrical input current from a plurality of input currents when the transfer roller is in the contact position based upon a print requirement, wherein the print requirement includes at least one of print quality, recording medium type, image parameters, print speed, and image tonal composition; and a roller displacement system structured to facilitate displacement of the transfer roller against the image receptor to contact same with a selectable rolling pressure when in the contact position, the roller displacement system including:

a motor producing a motor output in response to the electrical input current, and a linkage coupled to the motor and the transfer roller to displace the roller such that displacement of the roller occurs in response to the motor output, wherein the plurality of input currents determine the selectable rolling pressure of the transfer roller against the image receptor.

7. The printing device of claim 6 wherein the motor is a direct current motor.

8. The printing device of claim 6 wherein the motor is a brushless direct current motor.

9. The printing device of claim 6 wherein the motor is a stepper motor.

10. The printing device of claim 6 wherein the linkage comprises a plurality of linkage members.

11. The printing device of claim 6 wherein the linkage comprises a linkage pivot.

12. The printing device of claim 11 wherein the linkage comprises a plurality of linkage pivots.

13. The printing device of claim 6 wherein the linkage is adapted to translate the motor output to a transfer roller displacement force.

14. The printing device of claim 13 wherein the linkage is structured to communicate the transfer roller displacement force to the transfer roller.

15. The printing device of claim 13 wherein the motor output has a motor output force and the linkage is structured to translate the motor output force to proportionately higher transfer roller displacement force.

16. A method for biasing a transfer roller in a nip of a printing device, comprising:

determining a motor output force based upon a print requirement, the print requirement including at least one of print quality, recording medium type, image parameters, print speed, and image tonal composition, the motor output force corresponding to a desired backing pressure from among a plurality of selectable backing pressures;

actuating a roller displacement linkage motor;

applying the motor output force from the motor to a first end of a sector gear having a fixed pivot disposed therein; and displacing a roller assembly rigidly coupled to the sector gear to bring the transfer roller in contact with either of an image receptor or a recording medium in the nip to establish the desired backing pressure.

17. The printing device of claim 1, further comprising:

a position encoder to provide a motor shaft position to the controller; and a transconductance amplifier to receive a voltage signal from the controller and provide the electrical input current to the motor.

18. The method of claim 16, further comprising receiving a motor shaft position signal from a position encoder and using the motor shaft position signal to establish the desired backing pressure.

19. The method of claim 16, further comprising:

receiving a voltage signal from a controller;

producing a motor input current based on the voltage signal; and applying the motor output force responsive to the motor input current.

* * * * *